US005181673A

United States Patent [19]

Hubricht et al.

[11] Patent Number: 5,181,673

[45] Date of Patent: Jan. 26, 1993

[54] ANTI-TANK MISSILE SYSTEM

[75] Inventors: Gerhard Hubricht, Hagen; Bernd Schunk, Düsseldorf; Reinfried Stollewerk, Roetgen; Jörg Peters, Erkrath, all of Fed. Rep. of Germany

[73] Assignee: Rheinmetall GmbH, Dusseldorf, Fed. Rep. of Germany

[21] Appl. No.: 795,852

[22] Filed: Nov. 22, 1991

[30] Foreign Application Priority Data

Nov. 22, 1990 [DE] Fed. Rep. of Germany ..... 4037127

[51] Int. Cl.[5] ..... F41G 7/32

[52] U.S. Cl. ..... 244/3.12

[58] Field of Search ..... 244/3.11, 3.12, 3.14; 89/1.11, 41.05

[56] References Cited

U.S. PATENT DOCUMENTS

| | | | |
|---|---|---|---|
| 3,715,953 | 2/1973 | Allan | 89/41.05 |
| 3,986,682 | 10/1976 | Dryden | 244/3.17 |
| 4,004,487 | 1/1977 | Eichweber | 89/41.05 |
| 4,386,848 | 6/1983 | Clendenin et al. | 89/41.05 |
| 4,611,771 | 9/1986 | Gibbons et al. | 244/3.12 |
| 4,860,968 | 8/1989 | Pinson | 244/3.12 |
| 5,042,743 | 8/1991 | Carney | 244/3.11 |

OTHER PUBLICATIONS

"Low Cost PtSi Infrared Camera Systems—CAM6000 Series PtSi Schottky-Barrier Infrared Analog Camera Head", Fairchild Weston Systems, Inc., CCD Imaging Division, Milpitas, Calif., 1989, pp. 1-7.

"Pulnix CCD-Video-Kamera TM540/TM560" Pulnix America, Inc., Sunnyvale, Calif., 4 pages.

*Primary Examiner*—Charles T. Jordan

*Attorney, Agent, or Firm*—Spencer, Frank & Schneider

[57] ABSTRACT

An anti-tank missile system includes a weapons carrier system with a missile including control means for controlling the missile flight path and a searchhead camera for developing target data during flight of the missile. An elevatable platform is mounted on the weapons carrier system and a sighting device camera is disposed on the elevatable platform for sighting a target. Target data is compiled before a launch of the missile with the aid of the sighting device camera. A fire guidance computer in the weapons carrier system calculates a flight course for the missile. A light waveguide is connected between the missile and the weapons carrier system for transmitting target data developed by the searchhead camera for use by the fire guidance computer and for transmitting guidance signals generated by the fire guidance computer for controlling the control means for guiding the missile during its flight; and wherein the sighting device camera is a high resolution camera and the searchhead camera has at least one of a lower resolution and different spectral range than the sighting device camera.

3 Claims, 3 Drawing Sheets

1
2
3
4
5
6
7
8
α
β

ANTI-TANK MISSILE SYSTEM

BACKGROUND OF THE INVENTION

The present invention relates to an anti-tank missile system of the type disclosed in German Offenlegungsschrift [laid-open patent application] No. 3,734,758 wherein a camera in a weapon carrier initially determines relevant target data and transmits it to an electronic system of the missile. After the missile has been fired, it initially begins to fly on a predetermined flight profile established on the basis of the target data determined before its launch. Once the missile reaches a certain distance from the weapon carrier, the missile is automatically guided on the basis of target data determined by its built-in searchhead camera.

One drawback of this known anti-tank missile system is that a relatively expensive electronic system must be integrated in the missile in order to be able to utilize the appropriate target data to guide the missile.

An article by A. Widera, entitled "Lenkflugkörper mit Lichtwellenleitern", [Guided Missile Equipped with Light Waveguides], published in Jahrbuch der Wehrtechnik [Defense Technology Yearbook], Volume 17, (1987), pages 166–172, discloses another missile that is guided with the aid of light waveguides in which a built-in camera permits continuous observation of terrain which is flown over (the combat area and thus the targets). The recorded images are transmitted in real time via a light waveguide to a ground station and are there displayed on a monitor. The guidance system operator is then able to select the appropriate target and guide the missile toward that target or have the computer of the weapons system guide it toward the target.

A primary drawback of such a guided missile is that it requires a high resolution camera which is relatively expensive.

SUMMARY OF THE INVENTION

It is an object of the present invention to further develop an anti-tank missile system of the above-mentioned type in which the missile requires neither a relatively expensive electronic system nor a high resolution sensor system.

The above and other objects are accomplished in the context of an anti-tank missile system including a weapons carrier system, a missile carried on the weapons carrier system, the missile including control means for controlling the missile flight path and a searchhead camera for developing target data during flight of the missile, an elevatable platform mounted on the weapons carrier system, a sighting device camera disposed on the elevatable platform for sighting a target, with target data being compiled before a launch of the missile with the aid of the sighting device camera, and a fire guidance computer in the weapons carrier system for calculating a flight course for the missile, wherein according to the invention there is additionally provided a light waveguide connected between the missile and the weapons carrier system for transmitting target data developed by the searchhead camera for use by the fire guidance computer and for transmitting guidance signals generated by the fire guidance computer for controlling the control means for guiding the missile during its flight; wherein the sighting device camera is a high resolution camera and the searchhead camera has at least one of a lower resolution and different spectral range than the sighting device camera.

The present invention is thus essentially based on the concept of eliminating the expensive electronic system in the missile by employing a light waveguide (LWG) to guide the missile. Instead, the electronic system is included in the fire guidance computer and can thus also be utilized to fire other flying bodies. Moreover, compared to prior art LWG guided missiles, a missile system constructed according to the invention requires only a relatively inexpensive sensor system in the missile because the guidance system operator guides the missile initially on the basis of the image obtained by the sighting camera associated with the weapons carrier. Only when the missile has reached the vicinity of the target, where the searchhead camera on the missile depicts the target with sufficient resolution, will the guidance system operator or the computer of the weapons carrier system (tracking system) guide the missile into the target with the aid of the image from the missile searchhead camera.

The anti-tank missile system according to the invention also makes it possible to simultaneously guide several missiles, with the guidance system operator selecting the targets on the monitor of the sighting camera.

Details and advantages of the invention will now be described in greater detail for embodiments thereof and with reference to the drawing figures.

DETAILED DESCRIPTION OF PREFERRED EMBODIMENTS

Figure 1:
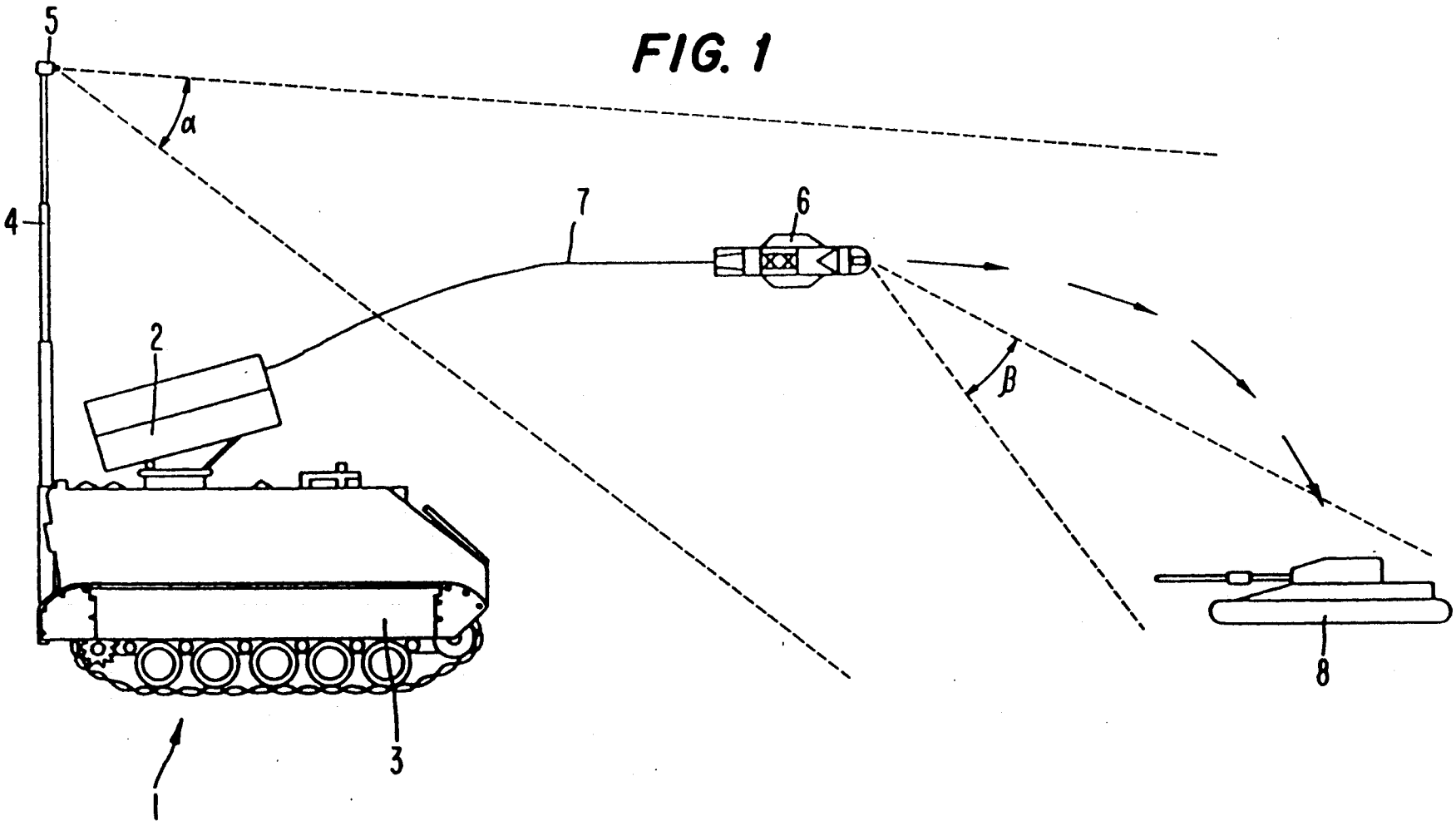
FIG. 1 is a schematic which shows an anti-tank missile system according to the invention.

Referring to FIG. 1, there is shown a weapons system 1 composed of a weapons carrier 3, such as an armored vehicle, including a missile launcher 2. A sighting device 5, including a high resolution camera, is disposed on an elevatable platform 4.

As shown, a missile 6 launched from weapons carrier 3 is connected by way of a light waveguide 7 with a fire guidance computer (not shown for reasons of clarity) disposed in armored vehicle 3. In the illustrated embodiment, the missile 6 is to be guided to a target 8.

Figure 2:
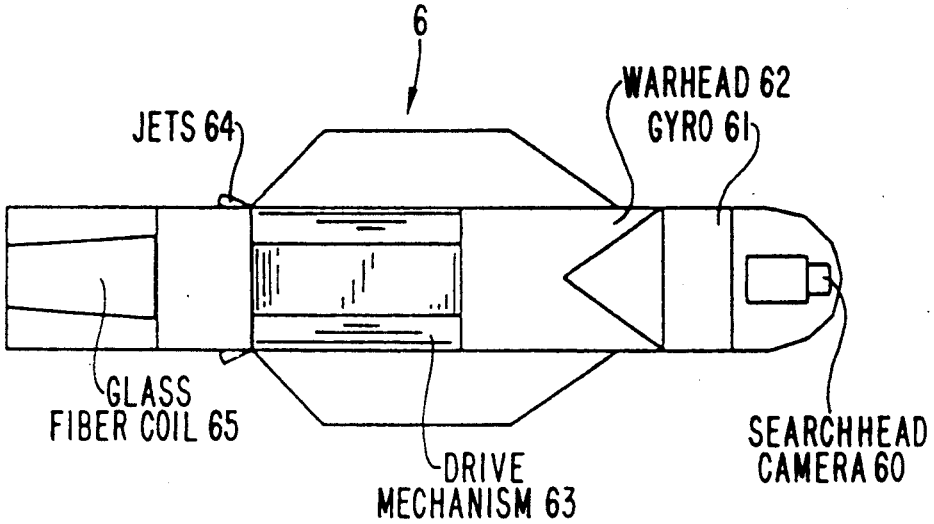
FIG. 2 is a schematic representation of a missile that can be employed in this system.

FIG. 2 is a schematic representation of a missile 6 that can be launched by the anti-tank missile system according to the invention. The missile is essentially composed of a searchhead including a camera 60 in its nose, a gyro system 61 for regulating flight position and navigation, an actual warhead 62, a glass fiber coil 65, and a drive mechanism 63 including control jets 64 for controlling the flight path of the missile. The viewing angle $\beta$ of searchhead camera 60 is less than the viewing angle $\alpha$ of sighting device camera 5. Additionally, searchhead camera 60 has a relatively lower resolution than that of sighting device camera 5, and/or a different spectral range than the sighting device camera.

Figure 3:
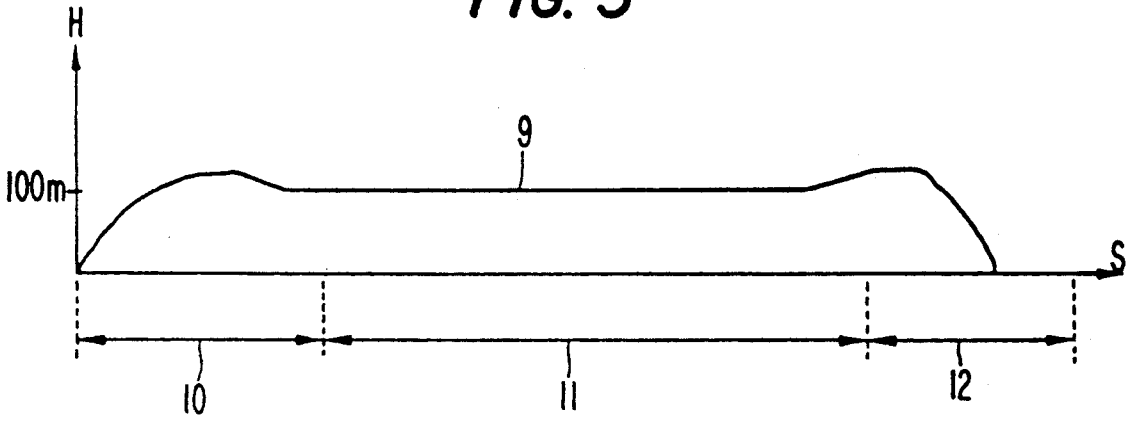
FIG. 3 is a diagram which shows the typical flight path of a missile launched by means of the system according to the invention.

FIG. 3 shows a typical flight path 9 from launch to target for a missile 6 launched by the apparatus according to the invention. One can distinguish essentially three phases, namely the starting phase 10, the traveling phase II and the combat phase 12. In FIG. 3, the letter H identifies the height and the letter S the distance from the weapons system.

Figure 4:
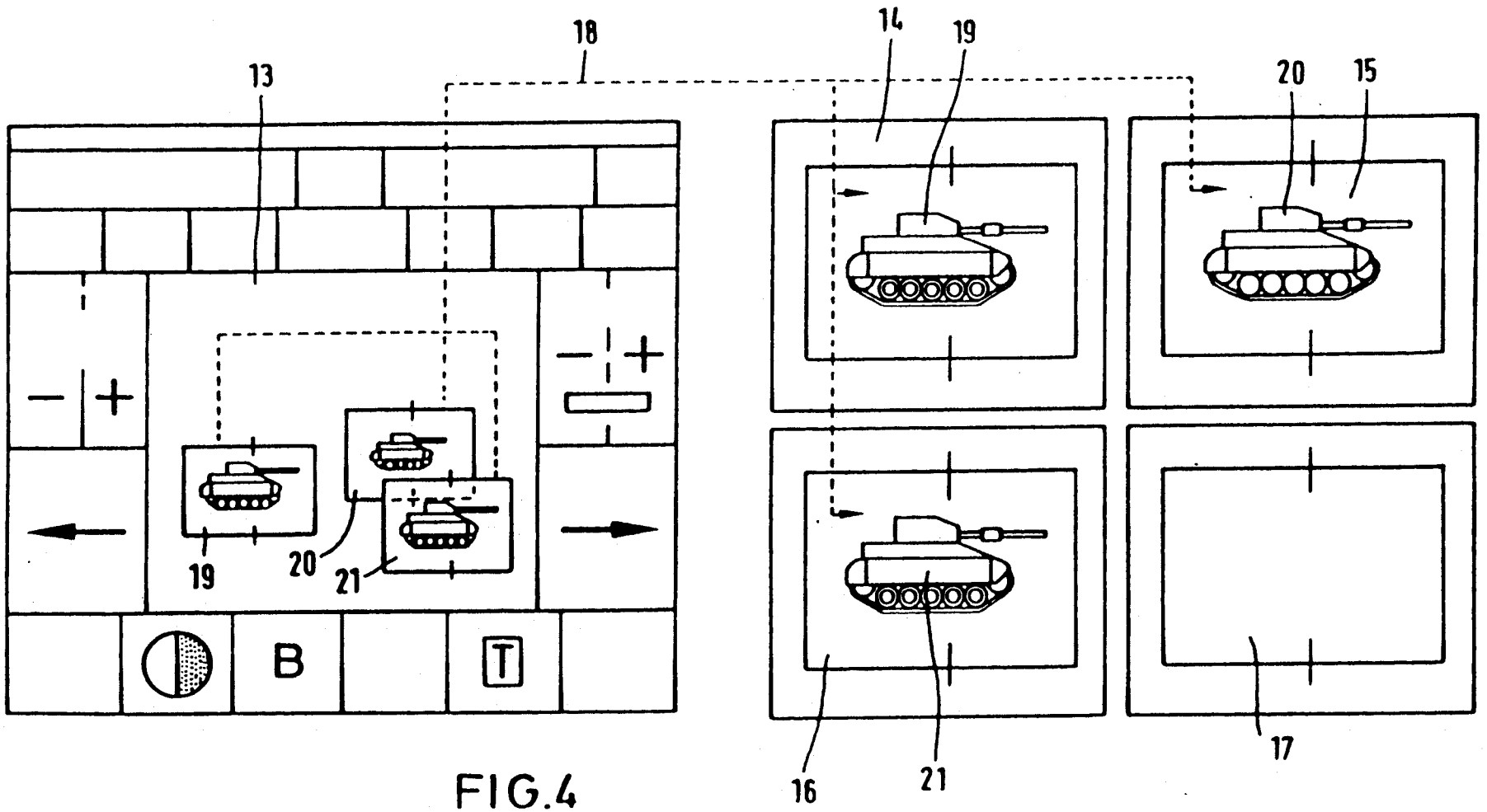
FIG. 4 is a schematic which shows typical monitor screens of the sighting system camera and of the missile camera to explain the invention.

FIG. 4 shows typical monitor images furnished by sighting device camera 5 and missile searchhead camera 60. Monitor 13 is associated with sighting device camera 5 and monitors 14 to 17 are associated with searchhead camera 60 of the missile.

The invention will now be described in greater detail with reference to FIGS. 1, 3 and 4.

In order to observe the target area, elevatable platform 4 is initially extended to an appropriate distance. The gunner watches the screen on the monitor 13 of the sighting device camera 5. Let it be assumed, for example, the three combat tanks 19, 20 and 21 are detected in the target area as depicted on monitor screen 13 by the guidance system operator.

The guidance system operator selects the target (e.g. tank 19). The fire guidance computer puts a frame around this target on the sighting system monitor 13. Then the fire guidance computer calculates the flight course to tank 19 from the angle position of camera 5 (FIG. 1) and from the image or monitor 13 picked up by the sighting system camera. After launching of the missile, the corresponding data are employed to guide missile 6 through glass fiber 7.

Missile 6 transmits gyro signals through glass fiber 7 to the fire guidance computer. From these signals, the fire guidance computer detects the position of missile 6 in space. The missile is then changed from the starting phase 10 to traveling phase 11. In order to prevent discovery of weapons system 1, the flight profile is almost rectangular, not ballistic. During traveling phase 11, missile 6 is guided by utilizing the gyro signals. At the same time, the fire guidance computer compares the image on sighting system monitor 13 with the image on missile searchhead monitor 14 which arrives through glass fiber 7 from searchhead camera 60. By means of image processing algorithms (e.g. correlations) the fire guidance computer recognizes the moment at which target 19 appears on searchhead monitor 14. As soon as this is the case, the final approach phase 12 is initiated. Missile 6 is now controlled solely with the aid of the image on searchhead monitor 14. If the target disappears from the monitor screen, the flight course is corrected accordingly. Since the guidance system operator has available the images from missile searchhead monitors 14 to 17, he is able to monitor the mission at all times and can thus, for example, abort the mission at the last moment or direct the missile to another target. Due to the fact that the missile can be guided by way of the missile searchhead camera, it is possible to also combat targets that the guidance system operator is unable to directly pick up with the sighting system camera.

The sighting device camera 5 may be, for example, an infrared sensitive camera (wave length approximately 3–5$\mu$), having a resolution of approximately 500×500 pixels, and a viewing angle of about 20° . A suitable infrared camera could be, for example, a CAM 6000 Series PtSi Schottky-Barrier camera of Fairchild Weston Systems, Inc., Milpitas, Calif.

The search head camera 60 may be, for example, a TV camera (wavelength 400–600nm) having a resolution of approximately 500×500 pixels or less, and a viewing angle of about 8°. A suitable search head camera could be, for example, a CCD Video Camera TM540 or TM560 of PULNIX American, Inc., Sunnyvale, Calif.

Obviously, numerous and additional modifications and variations of the present invention are possible in light of the above teachings. It is therefore to be understood that within the scope of the appended claims, the invention may be practiced otherwise than as specifically claimed.

What is claimed is:

1. In an anti-tank missile system including a weapons carrier system, a missile carried on the weapons carrier system, the missile including control means for controlling the missile flight path and a searchhead camera for developing target data during flight of the missile, an elevatable platform mounted on the weapons carrier system, a sighting device camera disposed on the elevatable platform for sighting a target, with target data being compiled before a launch of the missile with the aid of the sighting device camera, and a fire guidance computer in the weapons carrier system for calculating a flight course for the missile, the improvement comprising:

a light waveguide connected between said missile and said weapons carrier system for transmitting target data developed by said searchhead camera for use by said fire guidance computer and for transmitting guidance signals generated by said fire guidance computer for controlling said control means for guiding said missile during its flight; and wherein said sighting device camera is a high resolution camera and the searchhead camera has at least one of a lower resolution and different spectral range than said sighting device camera.

2. An anti-tank missile system as defined in claim 1, wherein said searchhead camera has a viewing angle $\beta$ and said sighting device camera has a viewing angle $\alpha$ which is greater than the viewing angle $\beta$.

3. A method for operating the anti-tank missile system defined in claim 1, comprising:

guiding the missile during starting and traveling phases of the missile on the basis of the target data supplied by the sighting device camera to the fire guidance computer and guiding the missile during a combat phase of the missile on the basis of the target data supplied by the searchhead camera to the fire guidance computer.

* * * * *